US010692454B2

(12) United States Patent
Lv et al.

(10) Patent No.: US 10,692,454 B2
(45) Date of Patent: Jun. 23, 2020

(54) GATE DRIVER ON ARRAY HAVING A CIRCUIT START SIGNAL APPLIED TO A PULL-DOWN MAINTENANCE MODULE

(71) Applicant: Shenzhen China Star Optoelectronics Semiconductor Display Technology Co., Ltd., Shenzhen (CN)

(72) Inventors: Xiaowen Lv, Shenzhen (CN); Yifang Chou, Shenzhen (CN)

(73) Assignee: Shenzhen China Star Optoelectronics Semiconductor Display Technology Co., Ltd., Shenzhen, Guangdong (CN)

( * ) Notice: Subject to any disclaimer, the term of this patent is extended or adjusted under 35 U.S.C. 154(b) by 326 days.

(21) Appl. No.: 15/742,886

(22) PCT Filed: Dec. 15, 2017

(86) PCT No.: PCT/CN2017/116303
§ 371 (c)(1),
(2) Date: Jan. 9, 2018

(87) PCT Pub. No.: WO2019/095484
PCT Pub. Date: May 23, 2019

(65) Prior Publication Data

US 2020/0105216 A1 Apr. 2, 2020

(30) Foreign Application Priority Data

Nov. 15, 2017 (CN) ..... 2017 1 1132610

(51) Int. Cl.
*G09G 3/36* (2006.01)

(52) U.S. Cl.
CPC ... *G09G 3/3677* (2013.01); *G09G 2310/0264* (2013.01); *G09G 2310/061* (2013.01)

(58) Field of Classification Search
CPC ..... G09G 3/3677
(Continued)

(56) References Cited

U.S. PATENT DOCUMENTS

2015/0255014 A1* 9/2015 Lin ..... G11C 19/28 345/84
2016/0140922 A1* 5/2016 Dai ..... G11C 19/287
2016/0284294 A1* 9/2016 Dai ..... G09G 3/3648

FOREIGN PATENT DOCUMENTS

CN 106448590 A 2/2017

* cited by examiner

*Primary Examiner* — Long D Pham
(74) *Attorney, Agent, or Firm* — Leong C. Lei

(57) ABSTRACT

The invention provides a GOA circuit, other than the first to the fourth GOA units, in each GOA unit: the first pull-down maintenance module receives the first control signal, low voltage signal, scan signal and circuit start signal, and is connected to the first node, wherein the 52$^{nd}$ TFT of the first pull-down maintenance module has a gate connected to the first node, a source receives the circuit start signal, and a drain connected to the gates of the 31$^{st}$ TFT and 41$^{st}$ TFT so that when the first node is at high voltage, the gate-source voltage difference of the 31$^{st}$ TFT and the 41$^{st}$ TFT are both negative to effectively reduce the current leakage and prevent the current leakage from affecting the voltage of the first node, to improve the circuit stability without additional signal lines, able to facilitate production cost reduction and achieving narrow border design.

15 Claims, 5 Drawing Sheets

(58) Field of Classification Search
USPC ..... 345/208
See application file for complete search history.

GATE DRIVER ON ARRAY HAVING A CIRCUIT START SIGNAL APPLIED TO A PULL-DOWN MAINTENANCE MODULE

BACKGROUND OF THE INVENTION

1. Field of the Invention

The present invention relates to the field of display techniques, and in particular to a gate driver on array (GOA) circuit.

2. The Related Arts

The liquid crystal display (LCD) provides many advantages, such as thinness, low power-consumption and no radiation, and is widely used in, such as, LCD televisions, mobile phones, personal digital assistants (PDAs), digital cameras, computer screens, laptop screens, and so on. The LCD technology also dominates the field of panel displays.

Most of the LCDs on the current market are of backlight type, which comprises an LCD panel and a backlight module. The operation theory behind LCD is to inject the liquid crystal (LC) molecules between a thin film transistor (TFT) array substrate and a color filter (CF) substrate, and applies a driving voltage between the two substrates to control the rotation direction of the LC molecules to refract the light from the backlight module to generate the image on the display.

In the active LCD, each pixel is electrically connected to a TFT, with a gate (Gate) connected to a horizontal scan line, a source (Source) connected to a data line in a vertical direction, and a drain (Drain) connected to a pixel electrode. When a sufficient positive voltage is applied to a horizontal scan line, all the TFTs connected to the scan line are turned on, the signal voltage loaded on the data line is written into the pixel to control the transmittance of different liquid crystals to achieve the effect of color control. The driving of the horizontal scan line of the current active LCD is mainly executed by an external integrated circuit (IC). The external IC can control the charge and discharge of the horizontal scan line in each stage progressively.

The gate driver on array (GOA) technology, i.e., the array substrate row driving technology, can use the array process of the LCD panel to manufacture the driver circuit of the horizontal scan lines on the substrate at area surrounding the active area to replace the external IC for driving the horizontal scan lines. The GOA technology can reduce the bonding process for external IC and has the opportunity to enhance yield rate and reduce production cost, as well as make the LCD panel more suitable for the production of narrow border display products.

FIG. 1 shows a schematic view of a known GOA circuit. The GOA circuit comprises a plurality of cascaded GOA units, with each of the GOA units comprising a pull-up control module 100', an output module 200', a pull-down module 300', a first pull-down maintenance module 400', and a second pull-down maintenance module 550'. For a positive integer N, except the first to the fourth GOA units and the last fourth to first GOA units, in the N-th GOA unit: the pull-up control module 100' comprises an eleventh TFT T11', the eleventh TFT T11' has a gate connected to cascade-propagate signal ST(N−4)' of the fourth previous GOA unit (i.e. the (N−4)-th GOA unit), the source connected to the high voltage signal VDD, and the drain connected to the first node Q(N)'. The output module 200' comprises a twenty-first TFT T21', a twenty-second TFT T22' and a first capacitor C1'; the twenty-first TFT T21' has a gate the first node Q(N)', a source connected to a clock signal CK', and a drain outputting a scan signal G(N)'; the twenty-second TFT T22' has a gate connected to the first node Q(N)', a source clock signal CK', and a drain outputting a cascade-propagate signal ST(N)'; the first capacitor C1' has one end connected to the first node Q(N)' and the other end connected to the drain of the twenty-first TFT T21'. The pull-down module 300's comprises a forty-third TFT T43', the forty-third TFT 43' has a gate connected to the fourth next GOA unit (i.e., (N+4)-th GOA unit), a source connected to the low voltage signal VSS, and a drain connected to the first node Q(N)'. The first pull-down maintenance module 400' comprises a thirty-first TFT T31', a forty-first TFT T41', a fifty-first TFT T51' and a fifty-second TFT T52'; the thirty-first TFT T31' has a gate connected to a second node P(N)', a source connected to the low voltage signal VSS, and a drain connected to the drain of the twenty-first TFT T21'; the forty-first TFT T41' has a gate connected to the second node P(N)', a source connected to the low voltage signal VSS, and a drain connected to the first node Q(N)'; the fifty-first TFT T51' has a gate and a source connected to a first control signal LC1', and a drain connected to the second node P(N)'; the fifty-second TFT T52' has a gate connected to the first node Q(N)', a source connected to the low voltage signal VSS, and a drain connected to the second node P(N)'. The second pull-down maintenance module 500' comprises a thirty-second TFT T32', a forty-second TFT T42', a sixty-first TFT T61' and a sixty-second TFT T62'; the thirty-second TFT T32' has a gate connected to a third node T(N)', a source connected to the low voltage signal VSS, and a drain connected to the drain of the twenty-first TFT T21'; the forty-second TFT T42' has a gate connected to the third node T(N)', a source connected to the low voltage signal VSS, and a drain connected to the first node Q(N)'; the sixty-one TFT T61' has a gate and a source connected to a second control signal LC2', and a drain connected to the third node T(N)'; the sixty-second TFT T62' has a gate connected to the first node Q(N)', a source connected to the low voltage signal VSS, and a drain connected to the third node T(N)'. The first control signal LC1 and the second control signal LC2 have opposite phases. Under the above GOA circuit structure, when the cascade-propagate signal ST(N−4)' of the (N−4)-th GOA unit is at high voltage, the eleventh TFT T11' is turned on to write the high voltage signal VDD to the first node Q(N)' to control the twenty-first TFT T21' and the twenty-second TFT T22' to output respectively a scan signal G(N)' corresponding to the clock signal CK' and the cascade-propagate signal ST(N)', while, at the same time, the fifty-second TFT T52' and the sixty-second TFT T62' are turned on to allow the low voltage signal VSS written into the gates of the forty-first TGT T41', forty-second TFT T42', thirty-first TFT T31', and thirty-second TFT T32'. Because the sources of the forty-first TGT T41', forty-second TFT T42', thirty-first TFT T31', and thirty-second TFT T32' are all connected to the low voltage signal VSS, the gate-source voltage difference between the gates and the sources of the forty-first TGT T41', forty-second TFT T42', thirty-first TFT T31', and thirty-second TFT T32' are all 0, so as to turn off the forty-first TGT T41', forty-second TFT T42', thirty-first TFT T31', and thirty-second TFT T32' when the GOA unit is outputting the scan signal G(N)' and the cascade-propagate signal ST(N)'. However, in the conventional case that a GOA circuit is formed by using an amorphous (a-Si) silicon TFT, a gate-source voltage difference of 0 is not a point with the TFT smallest current leakage, which causes a leakage in the forty-first TFT T41' forty-second TFT T42', thirty-first TFT T31', and thirty-second TFT T32', and affects the voltage level of the first node Q(n)'. In order to improve the performance of the GOA circuit, the current method is to use two low voltage signals with different voltage levels to make the gate of the TFT have a negative gate voltage to make the leakage current of the TFT smaller. However, this method requires additional signal lines, resulting in increased space for fanout layout, which is disadvantageous to narrow border design, increases the number of signals and increases the production cost.

SUMMARY OF THE INVENTION

The object of the present invention is to provide a GOA circuit, able to reduce the current leakage of the TFT in the first pull-down module to prevent the current leakage from affecting the voltage level of the first node, and to improve the circuit stability without additional signal lines, able to facilitate production cost reduction and achieving narrow border design.

To achieve the above object, the present invention provides a GOA circuit, which comprises a plurality of cascaded GOA units, with each GOA unit comprising: a pull-up control module, an output module, a pull-down module and a first pull-down maintenance module;

for an positive integer N, except the first to the fourth GOA units and the last fourth to the last GOA units, in the N-th GOA unit:

the pull-up control module receiving a cascade-propagate signal from (N−4)-th GOA unit and a high voltage signal, connected to a first node, for pulling up voltage at the first node to the high voltage signal based on the cascade-propagate signal from (N−4)-th GOA unit;

the output module receiving clock signal and connected to the first node, for outputting a scan signal and a cascade-propagate signal under control by the voltage of the first node; the pull-down module receiving a scan signal from (N+4)-th GOA unit and a low voltage signal, and connected to the first node, for pulling down voltage at the first node to the low voltage signal under the control of the scan signal of the (N+4)-th GOA unit;

the first pull-down maintenance module receiving a first control signal, the low voltage signal, the scan signal and a circuit start signal, connected to the first node, for maintaining the scan signal and the voltage of the first node at the low voltage signal after the pull-down module pulling down the voltage of the first node;

the circuit start signal being a pulse signal, and the circuit start signal having a low voltage level lower than the low voltage signal.

According to a preferred embodiment of the present invention, other than the first to fourth GOA units, in the N-th GOA unit: the first pull-down maintenance module comprises: a $31^{st}$ TFT, a $41^{st}$ TFT, a $51^{st}$ TFT and a $52^{nd}$ TFT; the $31^{st}$ TFT has a gate connected to a second node, a source connected to the low voltage signal, and a drain connected to the scan signal; the $41^{st}$ TFT has a gate connected to the second node, a source connected to the low voltage signal, and a drain connected to the first node; the $51^{st}$ TFT has a gate and a source connected to a first control signal, and a drain connected to the second node; the $52^{nd}$ TFT has a gate connected to the first node, a source connected to the circuit start signal, and a drain connected to the second node.

According to a preferred embodiment of the present invention, each GOA unit further comprises a second pull-down maintenance module, other than the first to fourth GOA units, in the N-th GOA unit: the second pull-down maintenance module comprises: a $32^{nd}$ TFT, a $42^{nd}$ TFT, a $61^{st}$ TFT and a $62^{nd}$ TFT; the $32^{nd}$ TFT has a gate connected to a third node, a source connected to the low voltage signal, and a drain connected to the scan signal; the $42^{nd}$ TFT has a gate connected to the third node, a source connected to the low voltage signal, and a drain connected to the first node; the $61^{st}$ TFT has a gate and a source connected to a second control signal, and a drain connected to the third node; the $62^{nd}$ TFT has a gate connected to the first node, a source connected to the circuit start signal, and a drain connected to the third node;

the first control signal and the second control signal have opposite phases.

According to a preferred embodiment of the present invention, the clock signal comprises: a first clock signal, a second clock signal, a third clock signal, a fourth clock signal, a fifth clock signal, a sixth clock signal, a seventh clock signal, and an eight clock signal, outputted serially; for a non-negative integer X, the (1+8X)-th GOA unit, the (2+8X)-th GOA unit, the (3+8X)-th GOA unit, the (4+8X)-th GOA unit, the (5+8X)-th GOA unit, the (6+8X)-th GOA unit, the (7+8X)-th GOA unit, and the (8+8X)-th GOA unit respectively receive the first clock signal, the second clock signal, the third clock signal, the fourth clock signal, the fifth clock signal, the sixth clock signal, the seventh clock signal, and the eight clock signal;

two adjacent clock signals have rising edges with a gap of 1/8 of cycle of the clock signal, the clock signal has a duty cycle ratio of 0.4;

the circuit start signal has a high voltage duration equal to 3/4 of the cycle of the clocks signal;

the circuit start signal has a rising edge earlier than the rising edge of the first clock signal, with a gap of 1/4 of the cycle of the clocks signal.

According to a preferred embodiment of the present invention, the low voltage level of circuit start signal and the low voltage signal have a voltage difference of 1.5-2.5V.

According to a preferred embodiment of the present invention, the low voltage level of circuit start signal is −8 and the low voltage signal is −6V.

According to a preferred embodiment of the present invention, except the first to the fourth GOA units, in the N-th GOA unit: the pull-up control module comprises: an $11^{th}$ TFT; the $11^{th}$ TFT having a gate connected to the cascade-propagate signal from the (N−4)-th GOA unit, a source connected to the high voltage signal, and a drain connected to the first node.

According to a preferred embodiment of the present invention, the output module comprises: a $21^{st}$ TFT, a $22^{nd}$ TFT, and a capacitor; the $21^{st}$ TFT having a gate connected to the first node, a source connected to the clock signal, and a drain outputting the scan signal; the $22^{nd}$ TFT having a gate connected to the first node, a source connected to the clock signal, and a drain outputting the cascade-propagate signal; the capacitor having one end connected to the first node and the other end connected to the drain of the $21^{st}$ TFT.

According to a preferred embodiment of the present invention, other than the last fourth to the last GOA units, in the N-th GOA unit: the pull-down module comprises: a $43^{rd}$ TFT, and the $43^{rd}$ TFT has a gate connected to scan signal of the (N+4)-th GOA unit, a source connected to the low voltage signal, and a drain connected to the first node;

in the last fourth to the last GOA units, the pull-down module comprises: a $43^{rd}$ TFT, and the $43^{rd}$ TFT has a gate connected to the circuit start signal, a source connected to the low voltage signal, and a drain connected to the first node.

According to a preferred embodiment of the present invention, in the first to the fourth GOA units, the pull-up control module comprises: an $11^{th}$ TFT, and the $11^{th}$ TFT has a gate connected to the circuit start signal, a source connected to the high voltage signal, and a drain connected to the first node; the first pull-down maintenance module comprises: a $31^{st}$ TFT, a $41^{st}$ TFT, a $51^{st}$ TFT and a $52^{nd}$ TFT; the $31^{st}$ TFT has a gate connected to the second node, a source connected to the low voltage signal, and a drain connected to the scan signal; the $41^{st}$ TFT has a gate connected to the second node, a source connected to the low voltage signal, and a drain connected to the first node; the $51^{st}$ TFT has a gate and a source connected to the first control signal, and a drain connected to the second node; the $52^{nd}$ TFT has a gate connected to the first node, a source connected to the low voltage signal, and a drain connected to the second node; the second pull-down maintenance module comprises: a $32^{nd}$ TFT, a $42^{nd}$ TFT, a $61^{st}$ TFT and a $62^{nd}$ TFT; the $32^{nd}$ TFT has a gate connected to the third node, a source connected to the low voltage signal, and a drain connected to the scan signal; the $42^{nd}$ TFT has a gate connected to the third node, a source connected to the low voltage signal, and a drain connected to the first node; the $61^{st}$ TFT has a gate and a source connected to the second control signal, and a drain connected to the third node; the $62^{nd}$ TFT has a gate connected to the first node, a source connected to the low voltage signal, and a drain connected to the third node.

The present invention also provides GOA circuit, which comprises a plurality of cascaded GOA units, with each GOA unit comprising: a pull-up control module, an output module, a pull-down module and a first pull-down maintenance module;

for an positive integer N, except the first to the fourth GOA units and the last fourth to the last GOA units, in the N-th GOA unit:

the pull-up control module receiving a cascade-propagate signal from (N−4)-th GOA unit and a high voltage signal, connected to a first node, for pulling up voltage at the first node to the high voltage signal based on the cascade-propagate signal from (N−4)-th GOA unit;

the output module receiving clock signal and connected to the first node, for outputting a scan signal and a cascade-propagate signal under control by the voltage of the first node; the pull-down module receiving a scan signal from (N+4)-th GOA unit and a low voltage signal, and connected to the first node, for pulling down voltage at the first node to the low voltage signal under the control of the scan signal of the (N+4)-th GOA unit;

the first pull-down maintenance module receiving a first control signal, the low voltage signal, the scan signal and a circuit start signal, connected to the first node, for maintaining the scan signal and the voltage of the first node at the low voltage signal after the pull-down module pulling down the voltage of the first node;

the circuit start signal being a pulse signal, and the circuit start signal having a low voltage level lower than the low voltage signal;

wherein other than the first to fourth GOA units, in the N-th GOA unit: the first pull-down maintenance module comprising: a $31^{st}$ TFT, a $41^{st}$ TFT, a $51^{st}$ TFT and a $52^{nd}$ TFT; the $31^{st}$ TFT having a gate connected to a second node, a source connected to the low voltage signal, and a drain connected to the scan signal; the $41^{st}$ TFT having a gate connected to the second node, a source connected to the low voltage signal, and a drain connected to the first node; the $51^{st}$ TFT having a gate and a source connected to a first control signal, and a drain connected to the second node; the $52^{nd}$ TFT having a gate connected to the first node, a source connected to the circuit start signal, and a drain connected to the second node;

wherein each GOA unit further comprising a second pull-down maintenance module, the second pull-down maintenance module comprising: other than the first to fourth GOA units, in the N-th GOA unit: a $32^{nd}$ TFT, a $42^{nd}$ TFT, a $61^{st}$ TFT and a $62^{nd}$ TFT; the $32^{nd}$ TFT having a gate connected to a third node, a source connected to the low voltage signal, and a drain connected to the scan signal; the $42^{nd}$ TFT having a gate connected to the third node, a source connected to the low voltage signal, and a drain connected to the first node; the $61^{st}$ TFT having a gate and a source connected to a second control signal, and a drain connected to the third node; the $62^{nd}$ TFT having a gate connected to the first node, a source connected to the circuit start signal, and a drain connected to the third node;

the first control signal and the second control signal have opposite phases;

wherein the clock signal comprising: a first clock signal, a second clock signal, a third clock signal, a fourth clock signal, a fifth clock signal, a sixth clock signal, a seventh clock signal, and an eight clock signal, outputted serially; for a non-negative integer X, the (1+8X)-th GOA unit, the (2+8X)-th GOA unit, the (3+8X)-th GOA unit, the (4+8X)-th GOA unit, the (5+8X)-th GOA unit, the (6+8X)-th GOA unit, the (7+8X)-th GOA unit, and the (8+8X)-th GOA unit respectively receive the first clock signal, the second clock signal, the third clock signal, the fourth clock signal, the fifth clock signal, the sixth clock signal, the seventh clock signal, and the eight clock signal;

two adjacent clock signals having rising edges with a gap of 1/8 of cycle of the clock signal, the clock signal has a duty cycle ratio of 0.4;

the circuit start signal having a high voltage duration equal to 3/4 of the cycle of the clocks signal;

the circuit start signal having a rising edge earlier than the rising edge of the first clock signal, with a gap of 1/4 of the cycle of the clocks signal;

wherein except the first to the fourth GOA units, in the N-th GOA unit: the pull-up control module comprising: an $11^{th}$ TFT; the $11^{th}$ TFT having a gate connected to the cascade-propagate signal from the (N−4)-th GOA unit, a source connected to the high voltage signal, and a drain connected to the first node.

wherein the output module comprising: a $21^{st}$ TFT, a $22^{nd}$ TFT, and a capacitor; the $21^{st}$ TFT having a gate connected to the first node, a source connected to the clock signal, and a drain outputting the scan signal; the $22^{nd}$ TFT having a gate connected to the first node, a source connected to the clock signal, and a drain outputting the cascade-propagate signal; the capacitor having one end connected to the first node and the other end connected to the drain of the $21^{st}$ TFT.

The present invention provides the following advantages. The present invention provides a GOA circuit, and in the GOA circuit, other than the first to the fourth GOA units, each GOA unit: the first pull-down maintenance module receives the first control signal, low voltage signal, scan signal and circuit start signal, and is connected to the first node, wherein the $52^{nd}$ TFT of the first pull-down maintenance module has a gate connected to the first node, a source receives the circuit start signal, and a drain connected to the gates of the 31st TFT and 41st TFT so that when the first node is at high voltage, the gate-source voltage difference of the 31st TFT and the 41st TFT are both negative to effectively reduce the current leakage and prevent the current leakage from affecting the voltage of the first node, to improve the circuit stability without additional signal lines, able to facilitate production cost reduction and achieving narrow border design.

BRIEF DESCRIPTION OF THE DRAWINGS

To make the technical solution of the embodiments according to the present invention, a brief description of the drawings that are necessary for the illustration of the embodiments will be given as follows. Apparently, the drawings described below show only example embodiments of the present invention and for those having ordinary skills in the art, other drawings may be easily obtained from these drawings without paying any creative effort. In the drawings.

DETAILED DESCRIPTION OF THE PREFERRED EMBODIMENTS

To further explain the technique means and effect of the present invention, the following uses preferred embodiments and drawings for detailed description.

Figure 1:
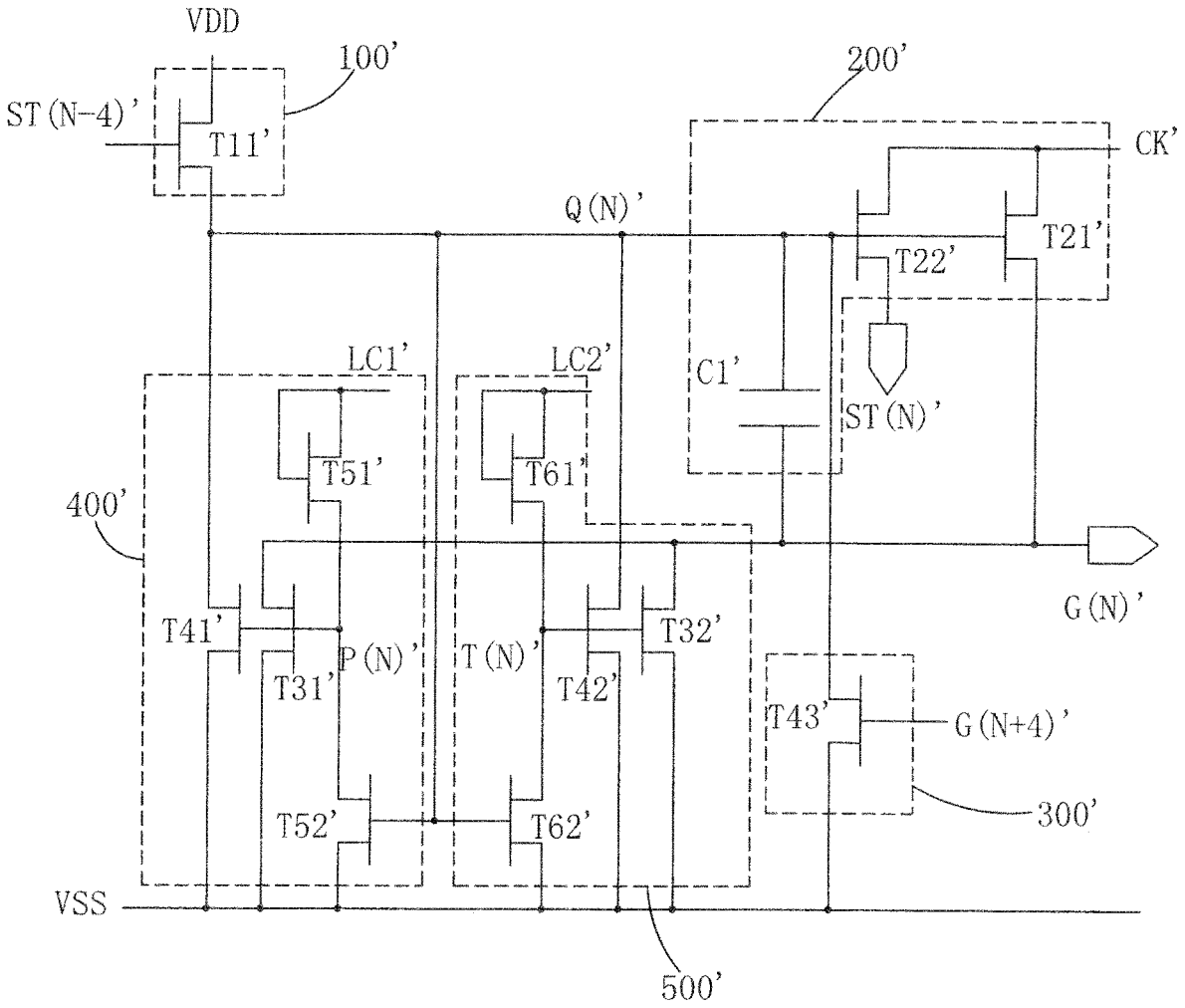
Fig. 1 PRIOR ART
FIG. 1 is a schematic view showing a known GOA circuit.
Figure 2:
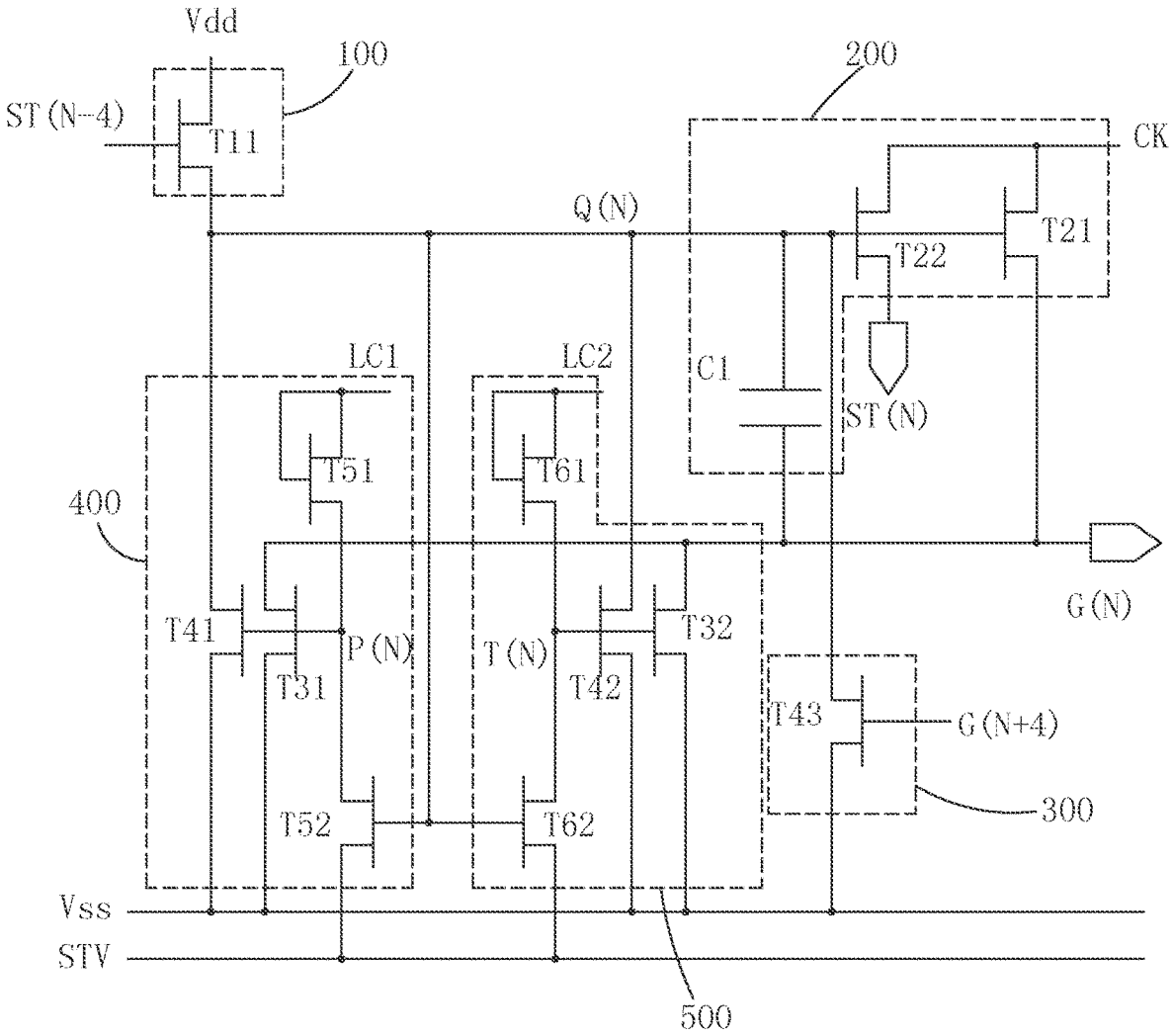
FIG. 2 is a schematic view showing a circuit of the GOA circuit provided by the first embodiment of the present invention.

Referring to FIG. 2, the present invention provides a GOA circuit, which comprises: a plurality of cascaded GOA units, with each GOA unit comprising: a pull-up control module 100, an output module 200, a pull-down module 300, and a first pull-down maintenance module 400;

for an positive integer N, except the first to the fourth GOA units and the last fourth to the last GOA units, in the N-th GOA unit:

the pull-up control module 100 receiving a cascade-propagate signal ST(N−4) from (N−4)-th GOA unit and a high voltage signal Vdd, connected to a first node Q(N), for pulling up voltage at the first node Q(N) to the high voltage signal Vdd based on the cascade-propagate signal ST(N−4) from (N−4)-th GOA unit.

Specifically, the pull-up control module 100 comprises: a 11th TFT T11; the 11th TFT T11 having a gate connected to the cascade-propagate signal ST(N−4) from the (N−4)-th GOA unit, a source connected to the high voltage signal Vdd, and a drain connected to the first node Q(N).

The output module 200 receives clock signal CK and connected to the first node Q(N), for outputting a scan signal G(N) and a cascade-propagate signal ST(N) under control by the voltage of the first node Q(N).

Specifically, the output module 200 comprises: a 21st TFT T21, a 22nd TFT T22, and a capacitor C1; the 21st TFT T21 having a gate connected to the first node Q(N), a source connected to the clock signal CK, and a drain outputting the scan signal G(N); the 22nd TFT T22 having a gate connected to the first node Q(N), a source connected to the clock signal CK, and a drain outputting the cascade-propagate signal ST(N); the capacitor having one end connected to the first node Q(N) and the other end connected to the drain of the 21st TFT T21.

The pull-down module 300 receives a scan signal G(N+4) from (N+4)-th GOA unit and a low voltage signal Vss, and connected to the first node Q(N), for pulling down voltage at the first node Q(N) to the low voltage signal Vss under the control of the scan signal G(N+4) of the (N+4)-th GOA unit;

The first pull-down maintenance module 400 receives a first control signal LC1, the low voltage signal Vss, the scan signal G(N) and a circuit start signal STV, and is connected to the first node Q(N), for maintaining the scan signal G(N) and the voltage of the first node Q(N) at the low voltage signal Vss after the pull-down module 300 pulling down the voltage of the first node Q(N); the circuit start signal STV is a pulse signal, and the circuit start signal STV has a low voltage level lower than the low voltage signal Vss.

Specifically, other than the first to fourth GOA units, in the N-th GOA unit: the first pull-down maintenance module 400 comprises: a 31st TFT T31, a 41st TFT T41, a 51st TFT T51 and a 52nd TFT T52; the 31st TFT T31 has a gate connected to a second node P(N), a source connected to the low voltage signal Vss, and a drain connected to the scan signal G(N); the 41st TFT T41 has a gate connected to the second node P(N), a source connected to the low voltage signal Vss, and a drain connected to the first node Q(N); the 51st TFT T51 has a gate and a source connected to a first control signal LC1, and a drain connected to the second node P(N); the 52nd TFT T52 has a gate connected to the first node Q(N), a source connected to the circuit start signal STV, and a drain connected to the second node P(N).

Moreover, refer to FIG. 2. Each GOA unit further comprises a second pull-down maintenance module 500. The second pull-down module 500 and the first pull-down module 400 operate alternatingly to maintain the scan signal and the voltage level at the first node Q(N) at the low voltage signal Vss after the pull-down module 300 pulls down the voltage level at the first node Q(N) to the low voltage signal Vss.

Specifically, other than the first to fourth GOA units, in the N-th GOA unit: the second pull-down maintenance module 500 comprises: a 32nd TFT T32, a 42nd TFT T42, a 61st TFT T61 and a 62nd TFT T62; the 32nd TFT T32 has a gate connected to a third node T(N), a source connected to the low voltage signal Vss, and a drain connected to the scan signal G(N); the 42nd TFT T42 has a gate connected to the third node T(N), a source connected to the low voltage signal Vss, and a drain connected to the first node Q(N); the 61st TFT T61 has a gate and a source connected to a second control signal LC2, and a drain connected to the third node T(N); the 62nd TFT T62 has a gate connected to the first node Q(N), a source connected to the circuit start signal SW, and a drain connected to the third node T(N). Specifically, the first control signal LC1 and the second control signal LC2 have opposite phases.

Specifically, the clock signal CK comprises: a first clock signal CK1, a second clock signal CK2, a third clock signal CK3, a fourth clock signal CK4, a fifth clock signal CK5, a sixth clock signal CK6, a seventh clock signal CK7, and an eight clock signal CK8, outputted serially; for a non-negative integer X, the (1+8X)-th GOA unit, the (2+8X)-th GOA unit, the (3+8X)-th GOA unit, the (4+8X)-th GOA unit, the (5+8X)-th GOA unit, the (6+8X)-th GOA unit, the (7+8X)-th GOA unit, and the (8+8X)-th GOA unit respectively receive the first clock signal CK1, the second clock signal CK2, the third clock signal CK3, the fourth clock signal CK4, the fifth clock signal CK5, the sixth clock signal CK6, the seventh clock signal CK7, and the eight clock signal CK8; two adjacent clock signals CK have rising edges with a gap of 1/8 of cycle of the clock signal CK, the clock signal CK has a duty cycle ratio of 0.4; the circuit start signal STV has a high voltage duration equal to 3/4 of the cycle of the clocks signal CK; the circuit start signal STV has a rising edge earlier than the rising edge of the first clock signal CK1, with a gap of 1/4 of the cycle of the clocks signal CK.

Specifically, the low voltage level of circuit start signal STV and the low voltage signal Vss have a voltage difference of 1.5-2.5V.

Preferably, the low voltage level of circuit start signal STV is −8 and the low voltage signal Vss is −6V.

Figure 3:
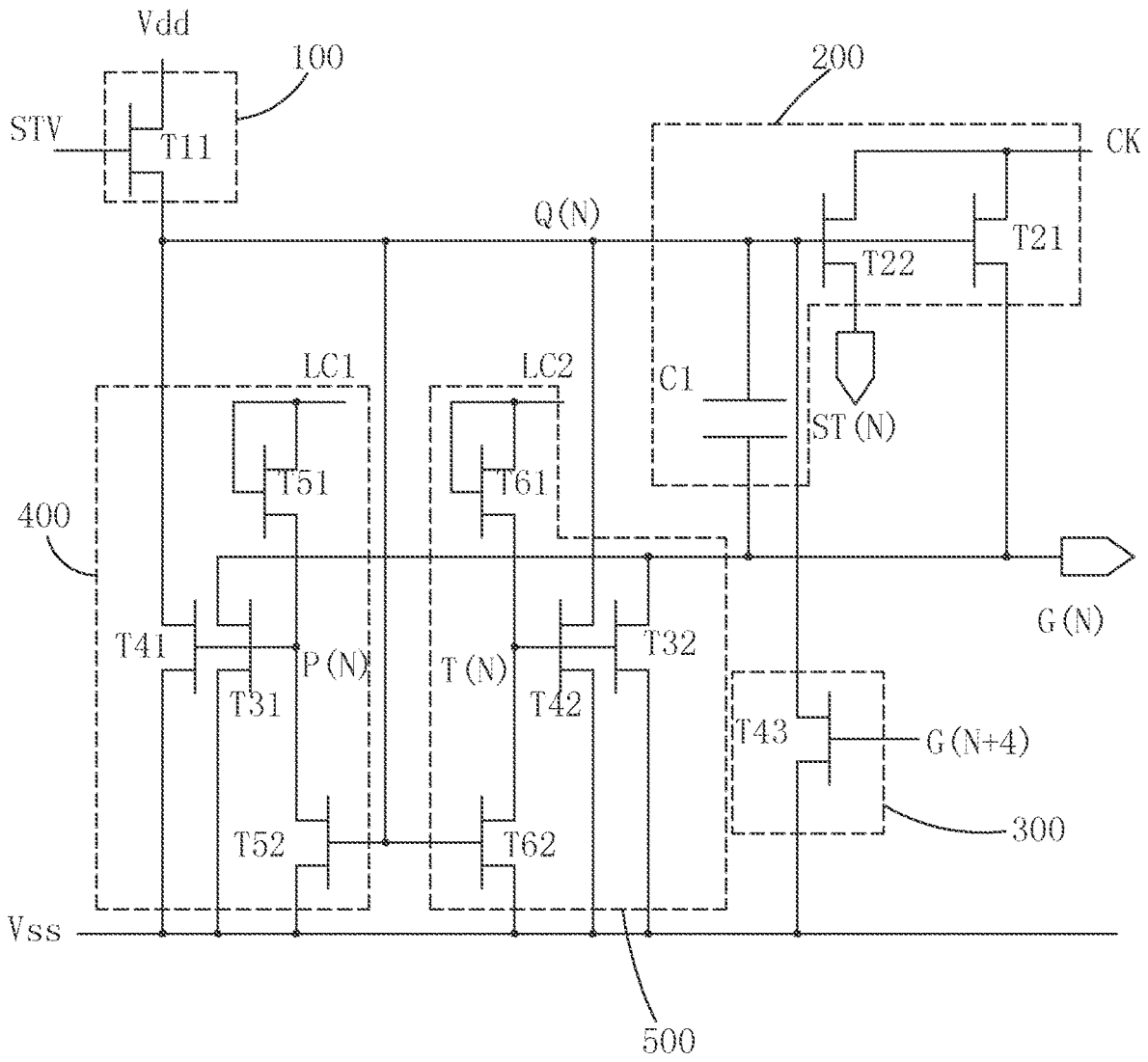
FIG. 3 is a schematic view showing a circuit of the first to the fourth GOA units of the GOA circuit provided by the embodiment of the present invention.

Specifically, refer to FIG. 3. In the first to the fourth GOA units:

the pull-up control module 100 comprises: an $11^{th}$ TFT T11, and the $11^{th}$ TFT T11 has a gate connected to the circuit start signal STV, a source connected to the high voltage signal Vdd, and a drain connected to the first node Q(N); the first pull-down maintenance module 400 comprises: a $31^{st}$ TFT T31, a $41^{st}$ TFT T41, a $51^{st}$ TFT T51 and a $52^{nd}$ TFT T52; the $31^{st}$ TFT T31 has a gate connected to the second node P(N), a source connected to the low voltage signal Vss, and a drain connected to the scan signal G(N); the $41^{st}$ TFT T41 has a gate connected to the second node P(N), a source connected to the low voltage signal Vss, and a drain connected to the first node Q(N); the $51^{st}$ TFT T51 has a gate and a source connected to the first control signal LC1, and a drain connected to the second node P(N); the $52^{nd}$ TFT T52 has a gate connected to the first node Q(N), a source connected to the low voltage signal Vss, and a drain connected to the second node P(N); the second pull-down maintenance module 500 comprises: a $32^{nd}$ TFT T32, a $42^{nd}$ TFT T42, a $61^{st}$ TFT T61 and a $62^{nd}$ TFT T62; the $32^{nd}$ TFT T32 has a gate connected to the third node T(N), a source connected to the low voltage signal Vss, and a drain connected to the scan signal G(N); the $42^{nd}$ TFT T42 has a gate connected to the third node T(N), a source connected to the low voltage signal Vss, and a drain connected to the first node Q(N); the $61^{st}$ TFT T61 has a gate and a source connected to the second control signal LC2, and a drain connected to the third node T(N); the $62^{nd}$ TFT T62 has a gate connected to the first node Q(N), a source connected to the low voltage signal Vss, and a drain connected to the third node T(N).

Figure 4:
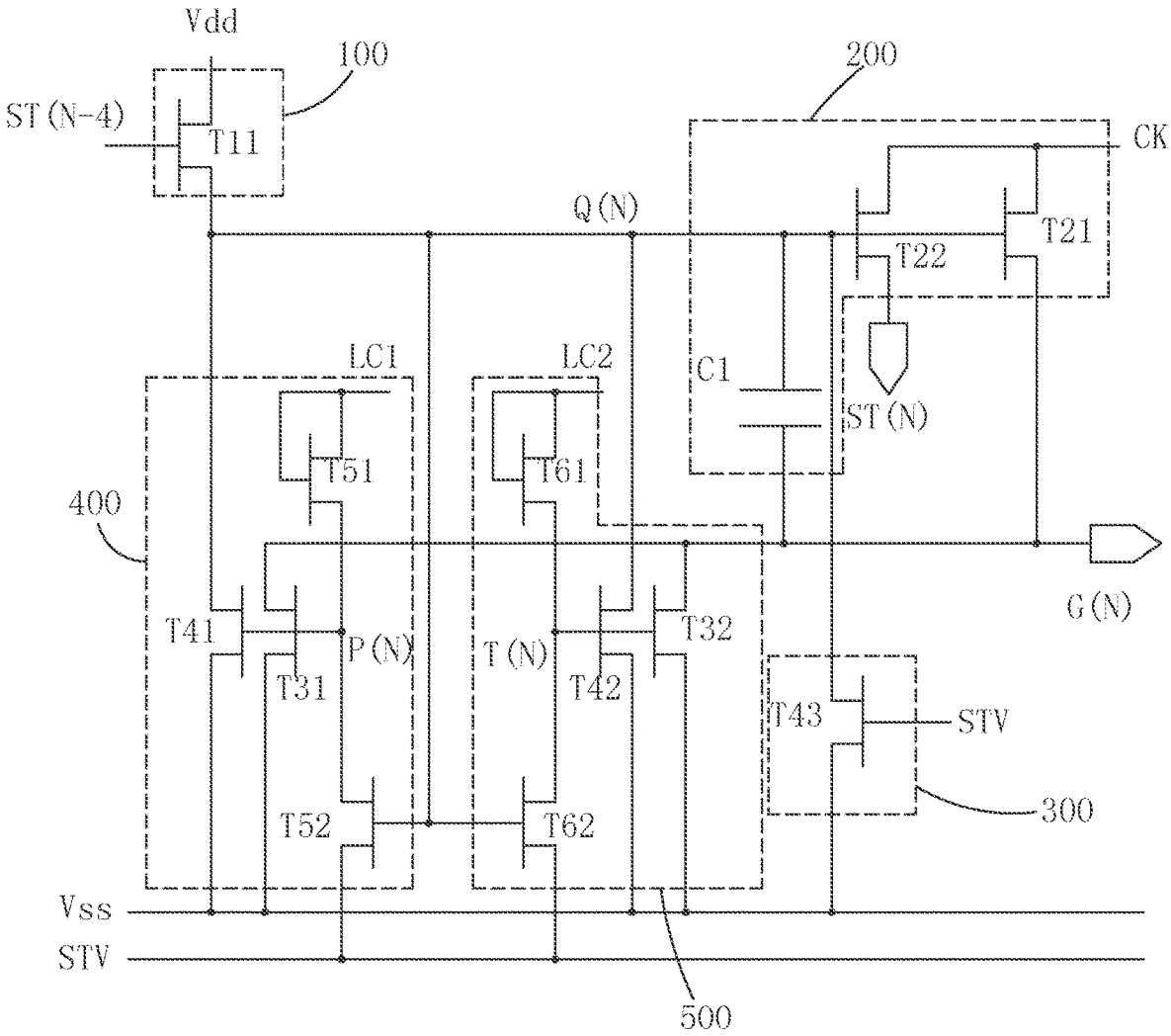
FIG. 4 is a schematic view showing a circuit of the last fourth to the last GOA units of the GOA circuit provided by the embodiment of the present invention.
Figure 5:
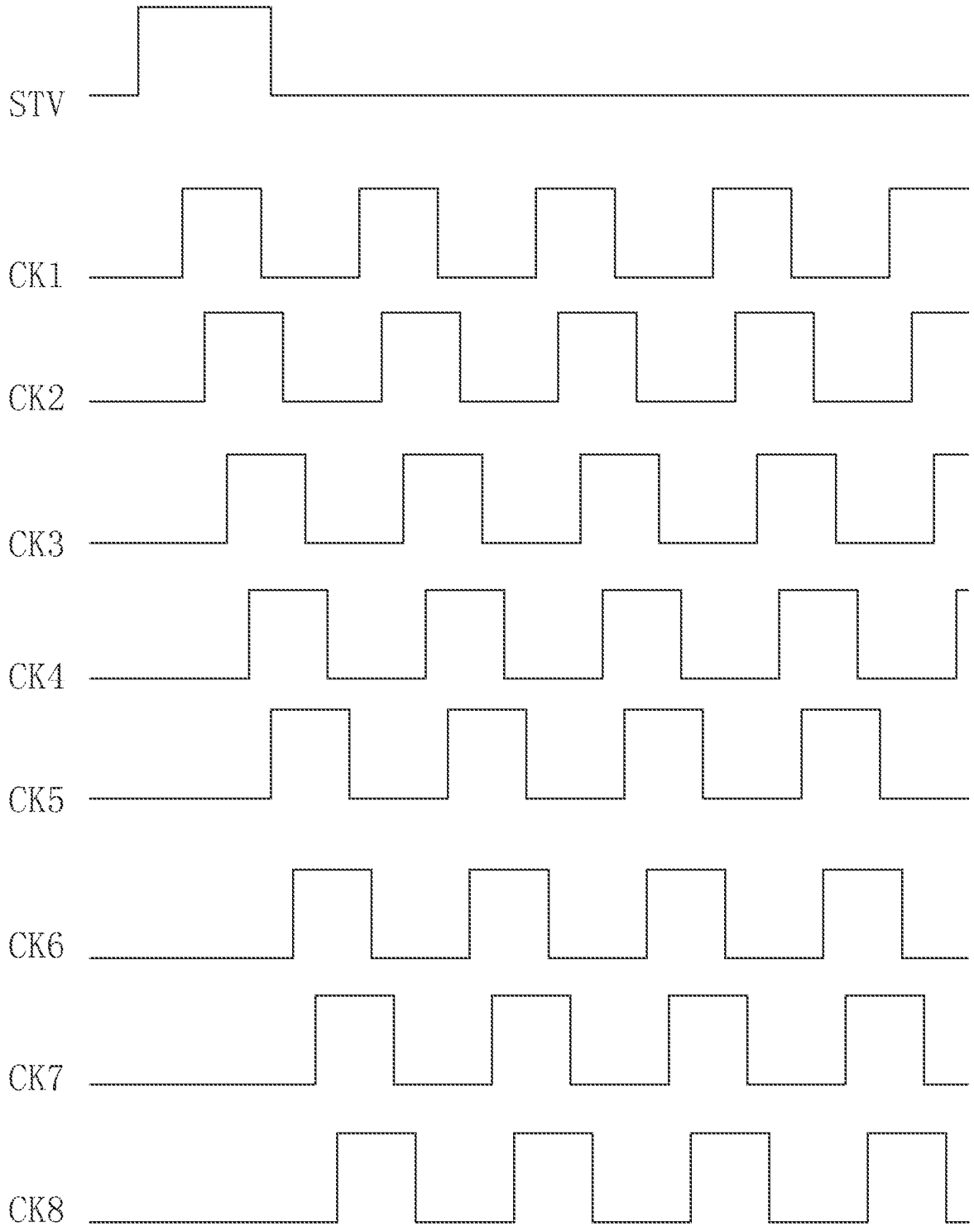
FIG. 5 is a schematic view showing the timing sequence for the GOA circuit by the embodiment of the present invention.

Specifically, refer to FIG. 4. In the last fourth to the last GOA units, the pull-down module 300 comprises: a $43^{rd}$ TFT T43, and the $43^{rd}$ TFT T43 has a gate connected to the circuit start signal STV, a source connected to the low voltage signal Vss, and a drain connected to the first node Q(N); and the pull-up control module 100, output module 200, first pull-down module 400, and second pull-down module 500 are all the same as the pull-up control module 100, output module 200, first pull-down module 400, and second pull-down module 500 in the fifth to last fifth GOA units.

Refer to FIG. 2 to FIG. 5. The operation of the GOA circuit of the present invention is as follows: the circuit start signal STV first provides a high voltage, the $11^{th}$ TFT T11 in the first to the fourth GOA units are turned on, and the voltage at the first node Q(N) in the first to the fourth GOA units rises to the high voltage, the $21^{st}$ TFT T21 and the $22^{nd}$ TFT T22 in the first to the fourth GOA units are both turned on, and then the first clock signal CK1 outputs a high voltage. The first GOA unit outputs the scan signal and the cascade-propagate signal; then, the second clock signal CK2 outputs the high voltage, and the second GOA unit outputs the scan signal and the cascade-propagate signal; then, the third clock signal CK3 outputs the high voltage, and the third GOA unit outputs the scan signal and the cascade-propagate signal; and then, the fourth clock signal CK4 outputs the high voltage, and the fourth GOA unit outputs the scan signal and the cascade-propagate signal. The cascade-propagate signals from the first GOA unit, the second GOA unit, the third GOA unit, and the fourth GOA unit are passed respectively to the pull-up control module 100 of the fifth GOA unit, the sixth GOA unit, the seventh GOA unit, the eighth GOA unit. After receiving the corresponding cascade-propagate signal, the $11^{th}$ TFT T11 of the fifth GOA unit, the sixth GOA unit, the seventh GOA unit, and the eighth GOA unit is turned on serially, and the fifth clock signal CK5, the sixth clock signal CK6, the seventh clock signal CK7, and the eighth clock signal CK8 serially start to provide a high voltage, and the fifth GOA unit, the sixth GOA unit, the seventh GOA unit, and the eighth GOA unit respectively output the scan signal and the cascade-propagate signal during the time when the fifth clock signal CK5, the sixth clock signal CK6, the seventh clock signal CK7, and the eighth clock signal CK8 are at high voltage. The pull-down module 300 of the first GOA unit, the second GOA unit, the third GOA unit, and the fourth GOA unit respectively receives the scan signal from the fifth GOA unit, the sixth GOA unit, the seventh GOA unit, and the eighth GOA unit, and correspondingly pull-down the first GOA unit, the second GOA unit, the third GOA unit, and the fourth GOA Unit to the voltage level of the low voltage signal Vss, and then the first pull-down maintenance module 400 or the second pull-down maintenance module 500 maintains the first node and the scan signal at the voltage level of the low voltage signal Vss, and so on, until the last fourth GOA unit, the last third GOA unit, the lasts second GOA unit, and the last GOA unit serially output the scan signal and the cascade-propagate signal, and the circuit start signal STV again provides a high voltage to the pull-down module 300 of the last fourth GOA unit, the last third GOA unit, the last second GOA unit, and the last GOA unit to pull-down the first node of the last fourth GOA unit, the last third GOA unit, the last second GOA unit, and the last GOA unit to the voltage level of low voltage signal Vss and the pull-down maintenance module 400 or the second pull-down maintenance module 500 of the last fourth GOA unit, the last third GOA unit, the last second GOA unit, and the last GOA unit maintains the first node and the scan signal at the voltage level of the low voltage signal Vss.

It should be noted that except the first to the fourth GOA units, in the N-th GOA unit, when the cascade-propagate signal ST(N−4) of the (N−4)-th GOA unit is high to turn on the $11^{th}$ TFT T11, the high voltage signal Vdd charges the first node Q(N) to reach the high voltage. At this point, the $52^{nd}$ TFT T52 and the $62^{nd}$ TFT T62 controlled by the first node Q(N) are turned on, so that the low voltage of the circuit start signal STV is inputted to the gates of the $41^{st}$ TFT T41, $31^{st}$ TFT T31, $42^{nd}$ TFT T42, and $41^{st}$ TFT T41, and the sources of the $41^{st}$ TFT T41, $31^{st}$ TFT T31, $42^{nd}$ TFT T42, and $41^{st}$ TFT T41 are all connected to the low voltage signal Vss. Because the low voltage of the circuit start signal STV is lower than the low voltage signal Vss, the gate-source voltage differences of the $41^{st}$ TFT T41, $31^{st}$ TFT T31, $42^{nd}$ TFT T42, and $41^{st}$ TFT T41 are all negative when the first node Q(N) is high, which can effectively reduce the leakage current of the $41^{st}$ TFT T41, $31^{st}$ TFT T31, $42^{nd}$ TFT T42, and $41^{st}$ TFT T41, prevent the leakage current from affecting the voltage of the first node Q(N), improve the circuit stability without additional signal lines, and can reduce product costs and achieve narrow border design.

In summary, the present invention provides a GOA circuit, and in the GOA circuit, other than the first to the fourth GOA units, each GOA unit: the first pull-down maintenance module receives the first control signal, low voltage signal, scan signal and circuit start signal, and is connected to the first node, wherein the $52^{nd}$ TFT of the first pull-down maintenance module has a gate connected to the first node, a source receives the circuit start signal, and a drain connected to the gates of the $31^{st}$ TFT and $41^{st}$ TFT so that when the first node is at high voltage, the gate-source voltage difference of the $31^{st}$ TFT and the $41^{st}$ TFT are both negative to effectively reduce the current leakage and prevent the current leakage from affecting the voltage of the first node, to improve the circuit stability without additional signal lines, able to facilitate production cost reduction and achieving narrow border design.

It should be noted that in the present disclosure the terms, such as, first, second are only for distinguishing an entity or operation from another entity or operation, and does not imply any specific relation or order between the entities or operations. Also, the terms "comprises", "include", and other similar variations, do not exclude the inclusion of other non-listed elements. Without further restrictions, the expression "comprises a . . . " does not exclude other identical elements from presence besides the listed elements.

Embodiments of the present invention have been described, but not intending to impose any unduly constraint to the appended claims. Any modification of equivalent structure or equivalent process made according to the disclosure and drawings of the present invention, or any application thereof, directly or indirectly, to other related fields of technique, is considered encompassed in the scope of protection defined by the claims of the present invention.

What is claimed is:

1. A gate driver on array (GOA) circuit, which comprises: a plurality of cascaded GOA units, with each GOA unit comprising: a pull-up control module, an output module, a pull-down module and a first pull-down maintenance module;

for an positive integer N, except the first to the fourth GOA units and the last fourth to the last GOA units, in the N-th GOA unit:

the pull-up control module receiving a cascade-propagate signal from (N−4)-th GOA unit and a high voltage signal, connected to a first node, for pulling up voltage at the first node to the high voltage signal based on the cascade-propagate signal from (N−4)-th GOA unit;

the output module receiving clock signal and connected to the first node, for outputting a scan signal and a cascade-propagate signal under control by the voltage of the first node;

the pull-down module receiving a scan signal from (N+4)-th GOA unit and a low voltage signal, and connected to the first node, for pulling down voltage at the first node to the low voltage signal under the control of the scan signal of the (N+4)-th GOA unit;

the first pull-down maintenance module receiving a first control signal, the low voltage signal, the scan signal and a circuit start signal, connected to the first node, for maintaining the scan signal and the voltage of the first node at the low voltage signal after the pull-down module pulling down the voltage of the first node;

the circuit start signal being a pulse signal, and the circuit start signal having a low voltage level lower than the low voltage signal.

2. The GOA circuit as claimed in claim 1, wherein other than the first to fourth GOA units, in the N-th GOA unit: the first pull-down maintenance module comprises: a $31^{st}$ TFT, a $41^{st}$ TFT, a $51^{st}$ TFT and a $52^{nd}$ TFT; the $31^{st}$ TFT has a gate connected to a second node, a source connected to the low voltage signal, and a drain connected to the scan signal; the $41^{st}$ TFT has a gate connected to the second node, a source connected to the low voltage signal, and a drain connected to the first node; the $51^{st}$ TFT has a gate and a source connected to a first control signal, and a drain connected to the second node; the $52^{nd}$ TFT has a gate connected to the first node, a source connected to the circuit start signal, and a drain connected to the second node.

3. The GOA circuit as claimed in claim 2, wherein each GOA unit further comprises a second pull-down maintenance module, other than the first to fourth GOA units, in the N-th GOA unit: the second pull-down maintenance module comprises: a $32^{nd}$ TFT, a $42^{nd}$ TFT, a $61^{st}$ TFT and a $62^{nd}$ TFT; the $32^{nd}$ TFT has a gate connected to a third node, a source connected to the low voltage signal, and a drain connected to the scan signal; the $42^{nd}$ TFT has a gate connected to the third node, a source connected to the low voltage signal, and a drain connected to the first node; the $61^{st}$ TFT has a gate and a source connected to a second control signal, and a drain connected to the third node; the $62^{nd}$ TFT has a gate connected to the first node, a source connected to the circuit start signal, and a drain connected to the third node;

the first control signal and the second control signal have opposite phases.

4. The GOA circuit as claimed in claim 3, wherein in the first to the fourth GOA units:

the pull-up control module comprises: an $11^{th}$ TFT, and the $11^{th}$ TFT has a gate connected to the circuit start signal, a source connected to the high voltage signal, and a drain connected to the first node; the first pull-down maintenance module comprises: a $31^{st}$ TFT, a $41^{st}$ TFT, a $51^{st}$ TFT and a $52^{nd}$ TFT; the $31^{st}$ TFT has a gate connected to the second node, a source connected to the low voltage signal, and a drain connected to the scan signal; the $41^{st}$ TFT has a gate connected to the second node, a source connected to the low voltage signal, and a drain connected to the first node; the $51^{st}$ TFT has a gate and a source connected to the first control signal, and a drain connected to the second node; the $52^{nd}$ TFT has a gate connected to the first node, a source connected to the low voltage signal, and a drain connected to the second node; the second pull-down maintenance module comprises: a $32^{nd}$ TFT, a $42^{nd}$ TFT, a $61^{st}$ TFT and a $62^{nd}$ TFT; the $32^{nd}$ TFT has a gate connected to the third node, a source connected to the low voltage signal, and a drain connected to the scan signal; the $42^{nd}$ TFT has a gate connected to the third node, a source connected to the low voltage signal, and a drain connected to the first node; the $61^{st}$ TFT has a gate and a source connected to the second control signal, and a drain connected to the third node; the $62^{nd}$ TFT has a gate connected to the first node, a source connected to the low voltage signal, and a drain connected to the third node.

5. The GOA circuit as claimed in claim 1, wherein the clock signal comprises: a first clock signal, a second clock signal, a third clock signal, a fourth clock signal, a fifth clock signal, a sixth clock signal, a seventh clock signal, and an eight clock signal, outputted serially; for a non-negative integer X, the (1+8X)-th GOA unit, the (2+8X)-th GOA unit, the (3+8X)-th GOA unit, the (4+8X)-th GOA unit, the (5+8X)-th GOA unit, the (6+8X)-th GOA unit, the (7+8X)-th GOA unit, and the (8+8X)-th GOA unit respectively receive the first clock signal, the second clock signal, the third clock signal, the fourth clock signal, the fifth clock signal, the sixth clock signal, the seventh clock signal, and the eight clock signal;

two adjacent clock signals have rising edges with a gap of 1/8 of cycle of the clock signal, the clock signal has a duty cycle ratio of 0.4;

the circuit start signal has a high voltage duration equal to 3/4 of the cycle of the clocks signal;

the circuit start signal has a rising edge earlier than the rising edge of the first clock signal, with a gap of 1/4 of the cycle of the clocks signal.

6. The GOA circuit as claimed in claim 1, wherein the low voltage level of circuit start signal and the low voltage signal have a voltage difference of 1.5-2.5V.

7. The GOA circuit as claimed in claim 6, wherein the low voltage level of circuit start signal is −4V and the low voltage signal is −6V.

8. The GOA circuit as claimed in claim 1, wherein except the first to the fourth GOA units, in the N-th GOA unit: the pull-up control module comprises: an $11^{th}$ TFT; the $11^{th}$ TFT having a gate connected to the cascade-propagate signal from the (N−4)-th GOA unit, a source connected to the high voltage signal, and a drain connected to the first node.

9. The GOA circuit as claimed in claim 1, wherein the output module comprises: a $21^{st}$ TFT, a $22^{nd}$ TFT, and a capacitor; the $21^{st}$ TFT having a gate connected to the first node, a source connected to the clock signal, and a drain outputting the scan signal; the $22^{nd}$ TFT having a gate connected to the first node, a source connected to the clock signal, and a drain outputting the cascade-propagate signal; the capacitor having one end connected to the first node and the other end connected to the drain of the $21^{st}$ TFT.

10. The GOA circuit as claimed in claim 1, wherein other than the last fourth to the last GOA units, in the N-th GOA unit: the pull-down module comprises: a $43^{rd}$ TFT, and the $43^{rd}$ TFT has a gate connected to scan signal of the (N+4)-th GOA unit, a source connected to the low voltage signal, and a drain connected to the first node;

in the last fourth to the last GOA units, the pull-down module comprises: a $43^{rd}$ TFT, and the $43^{rd}$ TFT has a gate connected to the circuit start signal, a source connected to the low voltage signal, and a drain connected to the first node.

11. A gate driver on array (GOA) circuit, which comprises:

a plurality of cascaded GOA units, with each GOA unit comprising: a pull-up control module, an output module, a pull-down module and a first pull-down maintenance module;

for an positive integer N, except the first to the fourth GOA units and the last fourth to the last GOA units, in the N-th GOA unit:

the pull-up control module receiving a cascade-propagate signal from (N−4)-th GOA unit and a high voltage signal, connected to a first node, for pulling up voltage at the first node to the high voltage signal based on the cascade-propagate signal from (N−4)-th GOA unit;

the output module receiving clock signal and connected to the first node, for outputting a scan signal and a cascade-propagate signal under control by the voltage of the first node;

the pull-down module receiving a scan signal from (N+4)-th GOA unit and a low voltage signal, and connected to the first node, for pulling down voltage at the first node to the low voltage signal under the control of the scan signal of the (N+4)-th GOA unit;

the first pull-down maintenance module receiving a first control signal, the low voltage signal, the scan signal and a circuit start signal, connected to the first node, for maintaining the scan signal and the voltage of the first node at the low voltage signal after the pull-down module pulling down the voltage of the first node;

the circuit start signal being a pulse signal, and the circuit start signal having a low voltage level lower than the low voltage signal;

wherein other than the first to fourth GOA units, in the N-th GOA unit: the first pull-down maintenance module comprising: a $31^{st}$ TFT, a $41^{st}$ TFT, a $51^{st}$ TFT and a $52^{nd}$ TFT; the $31^{st}$ TFT having a gate connected to a second node, a source connected to the low voltage signal, and a drain connected to the scan signal; the $41^{st}$ TFT having a gate connected to the second node, a source connected to the low voltage signal, and a drain connected to the first node; the $51^{st}$ TFT having a gate and a source connected to a first control signal, and a drain connected to the second node; the $52^{nd}$ TFT having a gate connected to the first node, a source connected to the circuit start signal, and a drain connected to the second node;

wherein each GOA unit further comprising a second pull-down maintenance module, other than the first to fourth GOA units, in the N-th GOA unit: the second pull-down maintenance module comprising: a $32^{nd}$ TFT, a $42^{nd}$ TFT, a $61^{st}$ TFT and a $62^{nd}$ TFT; the $32^{nd}$ TFT having a gate connected to a third node, a source connected to the low voltage signal, and a drain connected to the scan signal; the $42^{nd}$ TFT having a gate connected to the third node, a source connected to the low voltage signal, and a drain connected to the first node; the $61^{st}$ TFT having a gate and a source connected to a second control signal, and a drain connected to the third node; the $62^{nd}$ TFT having a gate connected to the first node, a source connected to the circuit start signal, and a drain connected to the third node;

the first control signal and the second control signal having opposite phases;

wherein the clock signal comprising: a first clock signal, a second clock signal, a third clock signal, a fourth clock signal, a fifth clock signal, a sixth clock signal, a seventh clock signal, and an eight clock signal, outputted serially; for a non-negative integer X, the (1+8X)-th GOA unit, the (2+8X)-th GOA unit, the (3+8X)-th GOA unit, the (4+8X)-th GOA unit, the (5+8X)-th GOA unit, the (6+8X)-th GOA unit, the (7+8X)-th GOA unit, and the (8+8X)-th GOA unit respectively receiving the first clock signal, the second clock signal, the third clock signal, the fourth clock signal, the fifth clock signal, the sixth clock signal, the seventh clock signal, and the eight clock signal;

two adjacent clock signals having rising edges with a gap of 1/8 of cycle of the clock signal, the clock signal having a duty cycle ratio of 0.4;

the circuit start signal having a high voltage duration equal to 3/4 of the cycle of the clocks signal;

the circuit start signal having a rising edge earlier than the rising edge of the first clock signal, with a gap of 1/4 of the cycle of the clocks signal;

wherein except the first to the fourth GOA units, in the N-th GOA unit: the pull-up control module comprising: an $11^{th}$ TFT; the $11^{th}$ TFT having a gate connected to the cascade-propagate signal from the (N−4)-th GOA unit, a source connected to the high voltage signal, and a drain connected to the first node;

wherein the output module comprising: a $21^{st}$ TFT, a $22^{nd}$ TFT, and a capacitor; the $21^{st}$ TFT having a gate connected to the first node, a source connected to the clock signal, and a drain outputting the scan signal; the $22^{nd}$ TFT having a gate connected to the first node, a source connected to the clock signal, and a drain outputting the cascade-propagate signal; the capacitor having one end connected to the first node and the other end connected to the drain of the $21^{st}$ TFT.

12. The GOA circuit as claimed in claim 11, wherein the low voltage level of circuit start signal and the low voltage signal have a voltage difference of 1.5-2.5V.

13. The GOA circuit as claimed in claim 11, wherein the low voltage level of circuit start signal is −4V and the low voltage signal is −6V.

14. The GOA circuit as claimed in claim 11, wherein other than the last fourth to the last GOA units, in the N-th GOA unit: the pull-down module comprises: a $43^{rd}$ TFT, and the $43^{rd}$ TFT has a gate connected to scan signal of the (N+4)-th GOA unit, a source connected to the low voltage signal, and a drain connected to the first node;

in the last fourth to the last GOA units, the pull-down module comprises: a $43^{rd}$ TFT, and the $43^{rd}$ TFT has a gate connected to the circuit start signal, a source connected to the low voltage signal, and a drain connected to the first node.

15. The GOA circuit as claimed in claim 11, wherein in the first to the fourth GOA units:

the pull-up control module comprises: an $11^{th}$ TFT, and the $11^{th}$ TFT has a gate connected to the circuit start signal, a source connected to the high voltage signal, and a drain connected to the first node; the first pull-down maintenance module comprises: a $31^{st}$ TFT, a $41^{st}$ TFT, a $51^{st}$ TFT and a $52^{nd}$ TFT; the $31^{st}$ TFT has a gate connected to the second node, a source connected to the low voltage signal, and a drain connected to the scan signal; the $41^{st}$ TFT has a gate connected to the second node, a source connected to the low voltage signal, and a drain connected to the first node; the $51^{st}$ TFT has a gate and a source connected to the first control signal, and a drain connected to the second node; the $52^{nd}$ TFT has a gate connected to the first node, a source connected to the low voltage signal, and a drain connected to the second node; the second pull-down maintenance module comprises: a $32^{nd}$ TFT, a $42^{nd}$ TFT, a $61^{st}$ TFT and a $62^{nd}$ TFT; the $32^{nd}$ TFT has a gate connected to the third node, a source connected to the low voltage signal, and a drain connected to the scan signal; the $42^{nd}$ TFT has a gate connected to the third node, a source connected to the low voltage signal, and a drain connected to the first node; the $61^{st}$ TFT has a gate and a source connected to the second control signal, and a drain connected to the third node; the $62^{nd}$ TFT has a gate connected to the first node, a source connected to the low voltage signal, and a drain connected to the third node.

* * * * *